United States Patent [19]

Kronberg

[11] Patent Number: 5,030,011

[45] Date of Patent: Jul. 9, 1991

[54] MIXING BLADE SYSTEM FOR HIGH-RESISTANCE MEDIA

[75] Inventor: James W. Kronberg, Beech Island, S.C.

[73] Assignee: The United States of America as represented by the United States Department of Energy, Washington, D.C.

[21] Appl. No.: 465,842

[22] Filed: Jan. 16, 1990

[51] Int. Cl.[5] ..... B01F 7/20

[52] U.S. Cl. ..... 366/279; 366/65; 366/325

[58] Field of Search ..... 366/279, 65, 66, 67, 366/325, 326, 327, 328, 329, 330, 309, 311, 312

[56] References Cited

U.S. PATENT DOCUMENTS

| | | | |
|---|---|---|---|
| 19,827 | 4/1858 | Brown | 366/325 |
| 95,075 | 9/1869 | Bradley | 366/325 |
| 135,281 | 1/1923 | McClure | 366/325 |
| 470,210 | 3/1892 | Pett | 366/329 |
| 764,157 | 7/1904 | Stacey | 366/325 |
| 1,276,383 | 8/1918 | Ludekens | 366/293 |
| 1,584,562 | 5/1926 | Kulenkampff | 366/325 |
| 1,845,329 | 2/1932 | Pierre | 366/325 |
| 3,081,983 | 3/1963 | Thibodeaux | 366/65 |
| 3,858,855 | 1/1975 | Hazen | 366/325 |
| 3,917,235 | 11/1975 | Deve | 366/329 |

FOREIGN PATENT DOCUMENTS

| | | | |
|---|---|---|---|
| 627051 | 3/1936 | Fed. Rep. of Germany | 366/325 |

*Primary Examiner*—Robert W. Jenkins

*Attorney, Agent, or Firm*—Stephen D. Hamel; Harold M. Dixon; William R. Moser

[57] ABSTRACT

A blade system for stirring and agitating a medium, comprising a shaft bearing a plurality of paddles, each having a different geometry and each having approximately the same rotational moment. The geometrically different paddles sweep through different volumes of the medium to minimize shear zone development and maximize the strength of the system with respect to medium-induced stress.

9 Claims, 2 Drawing Sheets

MIXING BLADE SYSTEM FOR HIGH-RESISTANCE MEDIA

CONTRACT STATEMENT

The United States Government has rights in this invention pursuant to Contract No. DE-AC09-76SR00001 between the U.S. Department of Energy and E.I. DuPont de Nemours & Co.

BACKGROUND OF THE INVENTION

1. Field of the Invention

The present invention relates to blade systems for stirring or agitating a medium, and more particularly, is directed towards maximizing the strength of the system with respect to medium-induced stress.

2. Discussion of Background

The movement of a fluid through a container (such as a pipe) is characterized by its viscosity, which can be thought of as a sort of "internal friction" or resistance of the fluid to a change in form. The higher the viscosity, the slower the movement of the fluid. Viscosity tends to decrease as the temperature of the fluid increases, so fluid tends to flow faster at higher temperatures.

Any fluid can be classified as one of two general types: a Newtonian fluid is one whose resistance to the passage of a moving object is wholly due to viscous effects, that is, strictly proportional to the speed of the object. Water and most oils are Newtonian fluids. A non-Newtonian fluid is one whose resistance to the passage of a moving object is not strictly proportional to its speed. Typically, such a fluid has "gel-like" properties, behaving as a solid at low levels of force and a liquid at higher ones. Common examples are jelly and wet cement.

Setting behavior in such diverse non-Newtonian fluids as jelly and wet cement is best characterized by measuring a property called "gel strength": that part of a non-Newtonian fluid's resistance to the passage of a moving object which is attributable to its gel-like nature. In practical terms it is the pressure exerted against an object moving steadily through the fluid, but so slowly that viscous effects are negligible. Gel strength, customarily measured in pounds per square foot (p.s.f). or kilograms per square meter ($kg/m^2$), is the force required to move a blade or other object through the setting mix at some specified uniform speed, over and above the force which would be required to move it through a non-setting, or Newtonian mix of equal viscosity. Usually a rotating assembly of two or more blades is used; the gel strength is then given by the ratio of shaft torque, corrected for viscosity, to the rotational moment of the blade assembly.

Typically, for any specific gel and stage of development, the gel strength is a sufficiently weak function of speed that, if the speed is held within a specified range, the effect of small variations may usually be neglected. Under uniform conditions of temperature and pressure, the gel strength typically increases with time, following an "S"-shaped curve. A period of little change just after mixing is followed by a roughly exponential increase to some peak or plateau value at which the gel strength levels off again. The timing of this process is highly dependent on batch composition, with even trace impurities sometimes showing a strong influence. Process optimization may thus require close monitoring of the time needed for each new batch to reach some specified gel strength or strengths.

A complication in gel-strength measurement is that mechanical disturbance tends to upset the gelling process; this is why wet cement can be carried for hours in mixing trucks without setting. Blade motion, therefore, must be as slow as possible for accurate gel-strength measurement. Low blade speeds also minimize the effects of viscosity, so that in general the measured gel strength can be used without correction. For most applications, a blade speed of about $2\times10^{-5}$ to $8\times10^{-5}$ meters per second is optimum.

Another complication is the tendency of a rotating blade assembly to "cut out a plug" from a setting mixture at some intermediate value of gel strength. A shear zone develops around the blade assembly, so that a cylindrical "plug" of mix, of the same outer radius as the blades, breaks away from the outer mass of mix. While setting continues in the plug and in the outer mass, the slippage disrupts gelling in the shear zone; blades and plug continue to turn, but the readings are falsely low since they reflect only the properties of one small, highly disturbed portion of the sample.

Furthermore, blades have typically been designed for use in media much weaker than the blade material, (such as metal blades for whipping cream, kneading dough, grinding coffee beans, etc.), so that blade failure through excessive medium resistance was not heretofore considered a realistic possibility. This possibility had to be addressed in the present invention because of the extremely broad range of strengths which might be encountered, even in a single sample, during the setting process of a medium such as cement.

SUMMARY OF THE INVENTION

Accordingly, a blade system for stirring and agitating a volume of medium includes a shaft with a blade assembly extending outward from the shaft, The blade assembly consists of a dimensioned set of nonadjacent dissimilar paddles, preferably four, each having a blade and a means for supporting the blade at a fixed distance from the shaft. Each paddle sweeps a different path defining a partial volume through the volume of medium, with the sum of these partial volumes being approximately equal to the volume of medium, and each of the paddles has approximately the same rotational moment.

The advantage of the present invention is that this configuration reduces by a factor equal to the number of blades present the amount of mechanical disruption experienced by any specific small volume of the mix. It also makes the development of a shear zone surrounding the blades less likely: as each blade introduces maximum shear at a different radial distance from the shaft, these contributions tend to cancel rather than reinforce each other.

At low mixing speeds this is an efficient data-gathering probe for gel-strength testing, discouraging the development of shear zones which may interfere with the gelling process by minimizing mechanical disturbance of the mix. Because this design maximizes the strength of the system with respect to media-induced stress, it is also useful for higher-speed applications, particularly high-force applications which would quickly destroy other blades.

Reference is now made in detail to the present preferred embodiment of the invention, an example of which is given in the accompanying drawings.

A BRIEF DESCRIPTION OF THE DRAWINGS

The accompanying drawings, which are incorporated in and form a part of the specification, illustrate the invention and, together with the description, serve to explain the principles of the invention. Tn the drawings:

FIG. 1 shows a side view of a single paddle according to the principles of the present invention.

FIGS. 2*a*, 2*b*, 2*c*, and 2*d* each show a side view of a paddle, the figures aligned to illustrate relative dimensions.

FIG. 3 shows a blade assembly in a mixing container, partially cut away, according to the present invention.

DETAILED DESCRIPTION OF THE INVENTION

Figures 1, 2A, 2B, 2C, 2D:
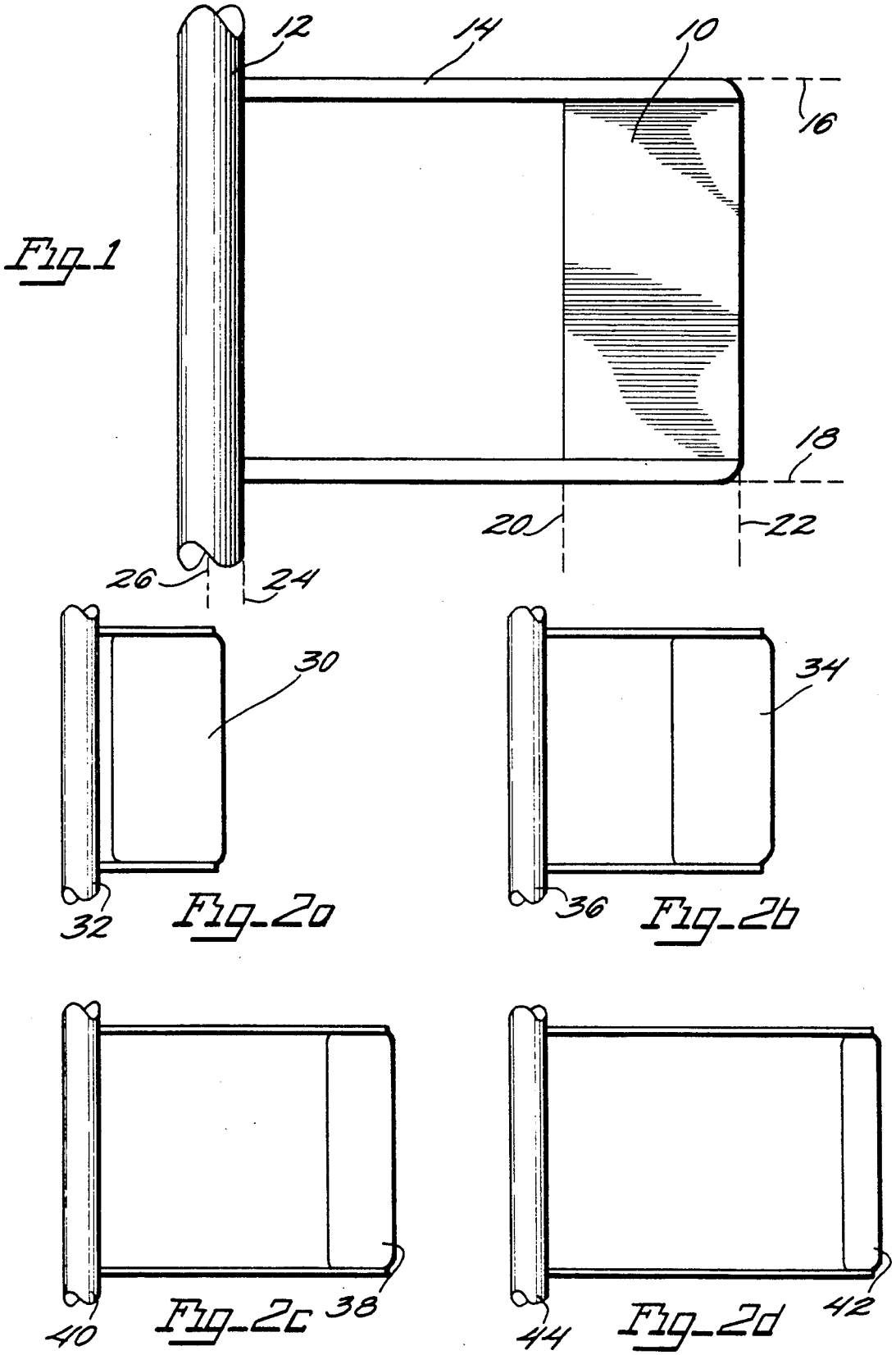

FIG. 1 shows a typical blade 10 made according to the preferred embodiment. The blade may be of virtually any geometric form, but is preferably flat and rectangular. Blade 10 is attached to central shaft 12 by radial supports 14, which are preferably two in number, of uniform circular cross-section, and placed on or near top edge line 16 and bottom edge line 18 of the blade. Supports 14 may end against innerblade edge 20, but preferably continue outward along top and bottom edges 16 and 18 to outer edge 22, as shown.

Blade 10, shaft 12, and supports 14 may be made from stainless steel or any other rigid material sufficiently resistant to abrasion and corrosion for the intended application. They are solidly assembled by welding, hard-soldering or a comparable technique, and are given a bright polished finish with all edges and corners smoothly rounded to facilitate cleaning. The thickness of blade 10 is preferably about one-half the diameter of supports 14, for strength and to facilitate welding or soldering.

The rotational moment of a rotating body is a quantity having the dimensions of volume (length×width×depth), and predicting the torque needed to turn the body against a steady pressure. Each leading surface element in contact with the fluid contributes a quantity equal to the projection of its area on a plane perpendicular to the motion, multiplied by its distance from the rotational axis. Trailing surface elements contribute nothing. The rotational moment is the sum of all such contributions. The rotational moment of blade 10, in its preferable form, may be calculated from the following dimensions:

- H: height; the distance between top edge line 16 and bottom edge line 18
- W: width; the distance between inner edge line 20 and outer edge line 22
- L: support length; the fixed distance between shaft outer surface 24 and inner edge line
- D: support diameter; the thickness of rods 14
- N: support number, preferably 2
- R: shaft radius; the distance between shaft outer surface 24 and center line 26.

If radial supports 14 continue outward past blade inner edge 20 to outer edge 22, the portions adjacent to the blade between these edges are considered to be parts of the blade. The rotational moment M is then given by:

$$M=\{NDL[(L/2)+R]\}+\{HW[(W/2)+L+R]\}$$

Slight errors result from drag effects at the blade edges and from rounding of the blade corners, but these effects are usually negligible.

Figure 3:
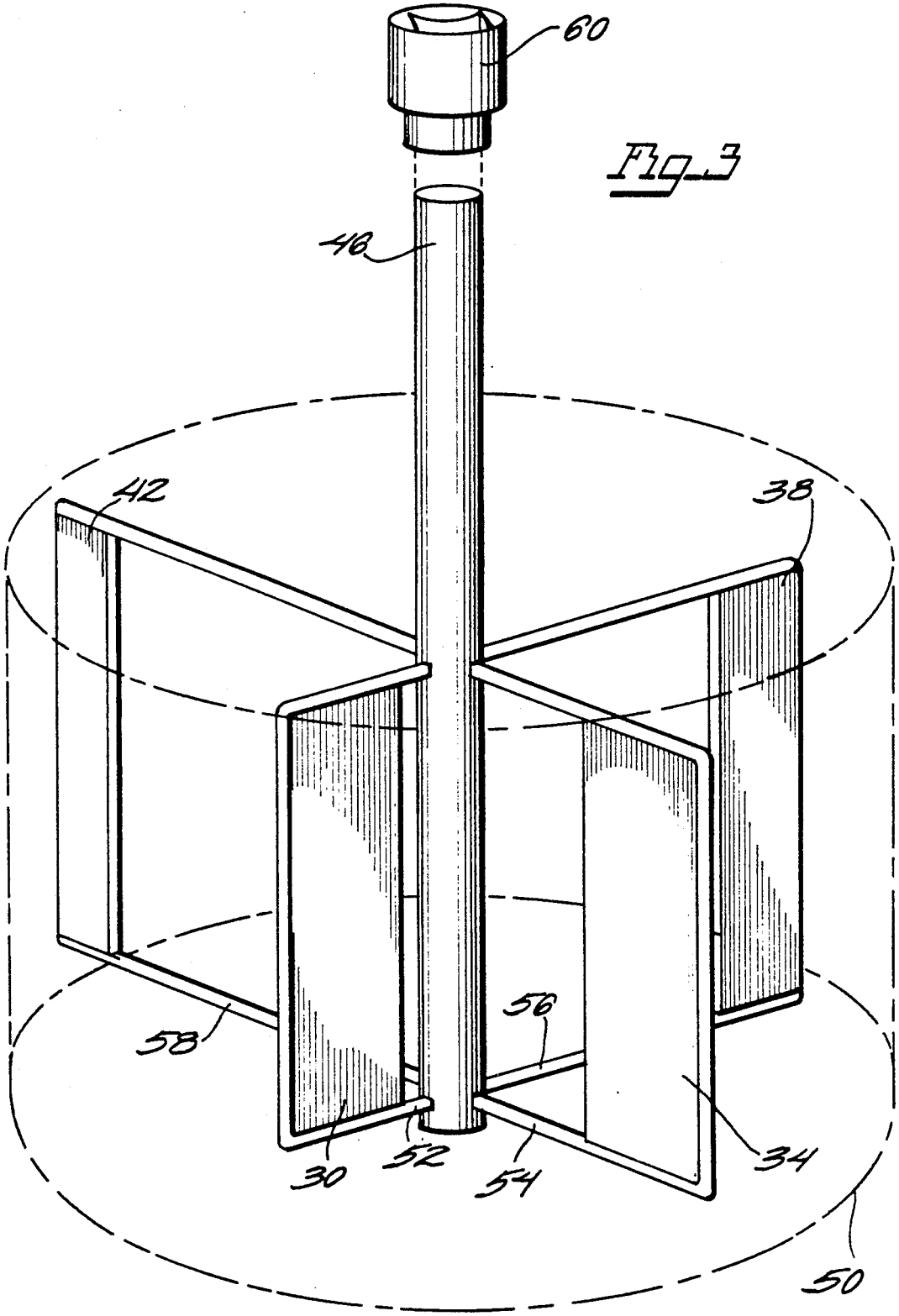

FIGS. 2*a* through *d* show the four blades 30, 34, 38, and 42 in a common plane as if each were attached to a separate shaft section 32, 36, 40, or 44, while FIG. 3 shows the completed system consisting of all four blades attached to a single, central shaft 46.

Each paddle is of a differing geometry. Referring to FIG. 1 and the preceding paragraph, all blades may or may not be of the same height H, although in the preferred embodiment, H is the same for all blades. With the paddles aligned as in FIGS. 2*a* through *d*, there is a steady increase in support length L and, preferably, a steady decrease in blade width W, from each paddle to the next.

In the preferred embodiment, the blade assembly consists of a dimensioned set of nonadjacent dissimilar paddles. The support length L for one paddle is roughly equal to the sum of the support length and blade width of the next, while the width of each blade is adjusted so that the rotational moments of all four paddles, as given by the equation above, are approximately equal. Equalizing the rotational moments equalizes the stresses at the points where the radial supports are attached to the central shaft, thus assuring that no one of the four paddles is substantially weaker than the others.

FIG. 3 shows one of several possible manners in which blades 30, 34, 38, and 42 may be attached to shaft 46 within the volume of a mixing container 50. All blades are preferably attached with their lowest radial supports 52, 54, 56, and 58 as close as possible to the lower end of shaft 46, with the blades and their supports equally spaced around the circumference of the shaft. While the blades are shown attached to the shaft clockwise in order of decreasing width, they may be attached in virtually any order without materially affecting the suitability of the blade assembly for its intended purpose.

A top fitting 60 may or may not be attached, by welding or otherwise, to the upper end of the shaft 46, such fitting being of a suitable type to facilitate connecting the blade system to a corresponding driving and torque-measuring means within the gel-strength tester, Alternatively, one or more flat surfaces, holes, or other features may be formed In the upper end of shaft 46 to facilitate such connection.

The preferred embodiment of the blade system is fabricated from 304L or 316L stainless steel, with all parts assembled by welding. As an example, dimensions are given below for an assembly having a nominal overall rotational moment of $8.24\times10^{-5}$ m$^3$, a height of $5.72\times10^{-2}$ m and an outside diameter of $1.00\times10^{-1}$ m, and thus suitable for testing a 0.75–1.0-liter sample held in a standard one-liter beaker. Obviously, many other alternative combinations of dimensions could also be used.

For example, four blades are fabricated from B&S 14- or 16-gauge sheet ($1.63\times10^{-3}$ m or $1.29\times10^{-3}$ m), their radial supports from 8-gauge or nominal ⅛-inch ($3.18\times10^{-3}$ m) round rod, and the central shaft from nominal ¼- inch ($6.35\times10^{-3}$ m) round rod of any length convenient to the application. Nominal D and R are thus both $3.18\times10^{-3}$ m. Two radial supports are used per blade, both extending to the outer edges of the blades; all blades are originally cut $5.08\times10^{-2}$ m high from sheet, but since the radial supports add 2D to this, the final H for each blade is $5.72\times10^{-2}$ m. Other dimensions (in units of $10^{-2}$ m) and calculated rotational moments (in $10^{-5}$ $m^3$), are as follows:

| Blade | L | W | L + W | M |
|---|---|---|---|---|
| 30 | 0.64 | 1.88 | 2.52 | 2.07 |
| 32 | 2.51 | 0.95 | 3.46 | 2.05 |
| 34 | 3.47 | 0.68 | 4.15 | 2.06 |
| 36 | 4.15 | 0.53 | 4.68 | 2.07 |

One or more of blades 30, 34, 38, and 42 may, if more convenient, be made from stock of circular or other cross-section yielding the same value for W. Similarly, stock of cross-sections other than circular may he used for supports 14. This stock need not be of uniform cross-section, provided that the correct value of D is maintained or suitable corrections are made in the calculation of M. For example, supports might be made thicker at those ends which are attached to shaft 46.

The rotational moment of the completed system is $8.24\times10^{-5}$ $m^3$. For measured torque of $1.00\times10^{-2}$ $kg/m^2$, therefore, the corresponding gel strength is 122 $kg/m^2$. At a shaft rotational speed of 0.01 RPM, the average blade speed is $2.78\times10^{-5}$ m/sec. Because gel strength is only a weak function of speed in the $2\times10^{-5}-8\times10^{-5}$ m/sec range, the fact that each blade has a different average speed is of little significance. Good experimental results have been obtained by assuming a uniform speed equal to the average for the whole assembly.

With good welds in 304L or 316L stainless steel, and assuming $2.46\times10^7$ $kg/m^2$ maximum stress at failure regardless of mode, calculated failure torques for various modes of failure are:

Shaft failure in torsion, through shearing: 1.23 kg-m
Shearing failure of radial supports at shaft: 4.94 kg-m
Bending failure of radial supports at shaft: 0.62 kg-m Hence, bending failure will be the first to occur. Generation of 0.62 kg-m would require a gel strength of 7570 $kg/m^2$. This is at least an order of magnitude larger than any gel strengths likely to be encountered in practice, except possibly in very late-stage setting concrete mixtures.

Equalizing the rotational moments of the paddles maximizes the overall strength of the blade system with respect to media-induced stress, While originally designed as a slow-moving, data-gathering probe causing minimal interference with gelling, the same type of assembly, or one built according to the same principles, could be used at higher speeds as an efficient mixer. Furthermore, it could be used in high-speed, high-force applications which would quickly destroy other blades.

The foregoing description of preferred embodiments of the invention has been presented for purposes of illustration and description. It is not intended to be exhaustive or to limit the invention to the precise form disclosed, and obviously many modifications and variations are possible in light of the above teachings. The embodiments were chosen and described in order to best explain the principles of the invention and its practical application to thereby enable one skilled in the art to best utilize the invention in various embodiments and with various modifications as are suited to the particular use contemplated. It will be obvious to one skilled in the art that other blade geometries are possible and fall within the scope of the invention. It is intended that the scope of the invention be defined by the claims appended hereto.

What is claimed is:

1. A blade system for stirring or agitating a volume of medium, the system comprising:
- a shaft;
- a blade assembly having a plurality of paddles attached to the shaft and extending outward therefrom, each paddle having
- a blade, and
- a means for supporting the blade at a fixed distance from the shaft;
- each paddle sweeping out a different path through the volume of medium defining a partial volume, the sum of the partial volumes defined by each paddle being approximately equal to the volume of medium; and
- each paddle dimensioned to have approximately the same rotational moment.

2. The blade system of claim 1, wherein the supporting means further comprises an upper and a lower support.

3. The blade system of claim 1, wherein the blades are in the form of rectangles, each having an upper edge and a lower edge perpendicular to the shaft, an inner edge and an outer edge parallel to the shaft, the width of the blades being the distance between the inner and the outer edges, the height of the blades being the distance between the upper and the lower edges, and the height of each blade being the same.

4. A multiple blade system, comprising:
- a shaft;
- a series of blade assemblies along the shaft, each blade assembly having
  - a plurality of paddles, each paddle having
    - a blade, and
    - a means for supporting the blade at a fixed distance from the shaft;
  - each paddle sweeping out a different path through the volume of medium defining a partial volume, the sum of the partial volumes defined by each paddle being approximately equal to the volume of medium; and
  - each paddle dimensioned to have approximately the same rotational moment.

5. The multiple blade system of claim 4, wherein the supporting means further comprises an upper and a lower support.

6. The multiple blade system of claim 4, wherein the blades are in the form of rectangles, each having an upper edge and a lower edge perpendicular to the shaft, an inner edge and an outer edge parallel to the shaft, the width of the blades being the distance between the inner and the outer edges, the height of the blades being the distance between the upper and the lower edges, and the height of each blade being the same.

7. A mixing apparatus, comprising:
- a container having a longitudinal axis;
- inlet means for introducing materials into the container;
- outlet means for discharging materials from the container;
- a shaft extending from one end of the container to the other end along its longitudinal axis;
- a means for rotating the shaft; and
- a plurality of blade assemblies, each with
  - a plurality of paddles, each paddle having
    - a blade, and
    - a means for supporting the blade at a fixed distance from the shaft;

each paddle sweeping out a different path through the volume of medium defining a partial volume, the sum of the partial volumes defined by each paddle being approximately equal to the volume of medium; and each paddle dimensioned to have approximately the same rotational moment.

8. The mixing apparatus of claim 7, wherein the supporting means further comprises an upper and a lower support.

9. The mixing apparatus of claim 7, wherein the blades are in the form of rectangles, each having an upper edge and a lower edge perpendicular to the shaft, an inner edge and an outer edge parallel to the shaft, the width of the blades being the distance between the inner and the outer edges, the height of the blades being the distance between the upper and the lower edges, and the height of each blade being the same.

* * * * *